US007946441B2

(12) United States Patent
Habitz et al.

(10) Patent No.: US 7,946,441 B2
(45) Date of Patent: May 24, 2011

(54) MOLDED PLASTIC CONTAINER ASSEMBLY WITH TEAR STRIP

(75) Inventors: Arthur W. Habitz, Berkley, MI (US); John Robert Salina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 524 days.

(21) Appl. No.: 11/836,861

(22) Filed: Aug. 10, 2007

(65) Prior Publication Data

US 2009/0039051 A1 Feb. 12, 2009

(51) Int. Cl.
*B65D 17/34* (2006.01)

(52) U.S. Cl. ..... 220/270; 215/256

(58) Field of Classification Search ..... 215/200; 220/265, 260, 802, 801, 798, 797, 796; D9/901; *B65D 41/32*

See application file for complete search history.

(56) References Cited

U.S. PATENT DOCUMENTS

| | | | | | |
|---|---|---|---|---|---|
| 3,515,334 | A * | 6/1970 | Jacobson | 229/200 |
| 4,024,976 | A * | 5/1977 | Acton | 215/50 |
| 4,296,871 | A * | 10/1981 | Andersson | 220/781 |
| 4,520,943 | A * | 6/1985 | Nielsen | 220/281 |
| 4,711,364 | A * | 12/1987 | Letica | 220/276 |
| 4,819,824 | A * | 4/1989 | Longbottom et al. | 220/266 |
| 5,219,087 | A * | 6/1993 | Christensson | 220/270 |
| 5,249,694 | A * | 10/1993 | Nelson | 220/276 |
| 5,518,133 | A * | 5/1996 | Hayes et al. | 220/793 |
| 5,617,968 | A * | 4/1997 | Luburic | 220/276 |
| 5,626,251 | A * | 5/1997 | Luburic et al. | 220/276 |
| 2003/0189048 | A1 * | 10/2003 | Luburic | 220/276 |
| 2004/0079757 | A1 * | 4/2004 | Ciccone | 220/836 |

FOREIGN PATENT DOCUMENTS

GB 2086862 A * 5/1982

* cited by examiner

*Primary Examiner* — Anthony Stashick
*Assistant Examiner* — Robert J Hicks
(74) *Attorney, Agent, or Firm* — Young Basile Hanlon & MacFarlane, PC

(57) ABSTRACT

A molded plastic container assembly comprising an open top container and a closure which sealingly fits on the top of the container. A collar is integral with the container sidewall just below the top rim to provide a space into which the lower edge of the closure skirt extends to prevent removal closure until a tear strip formed in the collar is removed. The tear strip in the collar extends fully through one corner of the container assembly and at least half way toward both of the adjacent corners to provide substantial area of access to the closure lower edge as well make the tear strip to large to present a choking hazard to small children.

4 Claims, 3 Drawing Sheets

MOLDED PLASTIC CONTAINER ASSEMBLY WITH TEAR STRIP

FIELD OF THE INVENTION

This invention relates to molded plastic container assemblies comprising the combination of a generally rectangular container and a closure or lid which fits sealingly on the upper rim of the container to protect perishable contents such as food products or the like. Access to the lower edge of the lid for removal purposes is provided by means of a tear strip in a radial outstanding collar adjacent the upper rim of the container.

SUMMARY

The invention is a molded plastic container assembly comprising a generally rectangular container having a closed bottom and an open top defining a generally rectangular sidewall terminating in an upper rim. An integral collar surrounds the container sidewall in outwardly spaced relation thereto below the rim to define a continuous space between the collar and the sidewall which receives the lower edge of the closure when seated on the open top of the container thereby to prevent removal of the closure.

In accordance with the invention, the collar is provided with a frangible tear line which extends fully through and on opposite sides of one corner of the container and at least approximately halfway to the two adjacent corners such that a long upper portion of the collar may be removed to provide manual access to the lower edge of the closure. The benefits of the large removable tear strip include increased finger space for contacting and lifting the lower edge of the closure as well as to render the removed tear strip less likely to pose a choke hazard to infants or small children after it has been removed from the container.

As is hereinafter described the preferred form of the invention includes a starter tab on one edge of the tear strip and an irregular width wherein the tear strip is widest as it goes around the corner of the container the narrowest at its opposite ends. The invention is illustrated in connection with a 48 oz. generally rectangular food container intended for making retail sales of produce such as potato salad, pudding and the like. However, it is to be understood that the container of the subject invention may be used in connection with any product with respect to which it is beneficial to provide an indication of container tampering or previous openings.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
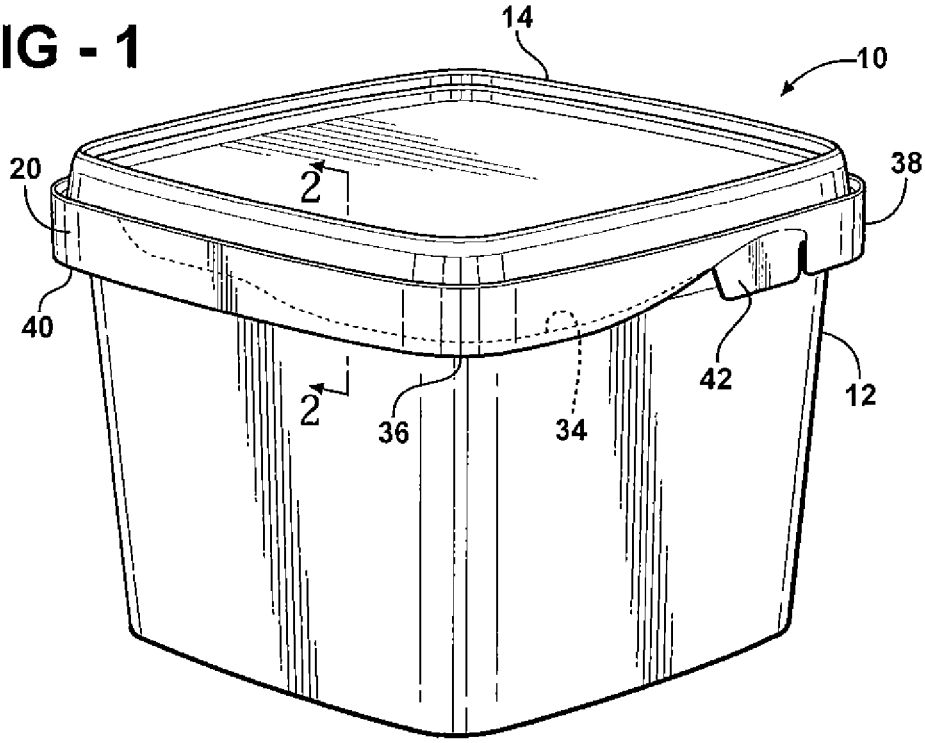
FIG. 1 is a perspective view of a container assembly illustrating the invention.

Referring now to the drawings there were shown container assembly 10 which is ejection molded of a suitable plastic such as polyethylene, polypropylene, or polystyrene. The container assembly 10 comprises generally rectangular tapered container 12 of the type having a closed bottom and an open top. The container assembly 10 further comprises generally rectangular plastic closure 14.

The container 12 is defined by a generally rectangular continuous sidewall 16 having four regularly spaced corners and terminating in a flangeless upper peripheral rim 18. An integral collar 20 fully and continuously surrounds the upper regions of the container sidewall 16 in radially outwardly spaced relationship as a result of the integral spacer ribs 22. The collar 20 is disposed below the top surface of the rim 18 and, as a result of the spacing ribs 22, defines a space 24 the purpose of which is hereinafter defined.

Figure 2:
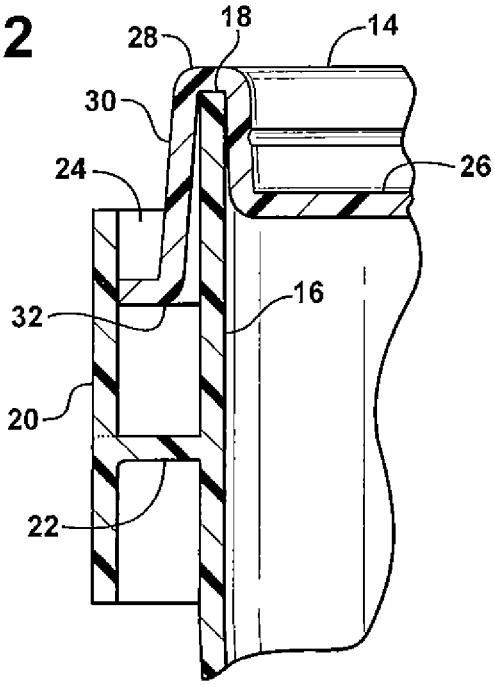
FIG. 2 is partial sectional view of the container assembly of FIG. 1 showing the manner in which the closure fits on the container and extends into a space between a peripheral collar integral with the container sidewall.

The closure 14 is also generally rectangular and made out of a slightly resilient plastic material by injection molding or other suitable forming process. The closure 14 comprises a generally rectangular center deck 26 and an integral inverted u-shaped peripheral channel 28 having an outer wall 30 or an outer wall or skirt 30 which terminates in a lower edge 32. When the closure 14 is sealing seated on the container sidewall 16 as shown in FIG. 2, the skirt 30 extends into the space 24 between the collar 20 and sidewall 16 so that the lower edge 32 of the skirt 30 can not be access manually to remove the closure 14 from the container 12.

As shown best in FIGS. 1 and 3-5, a tear line 34 which is made frangible by perpetration or thinning extends fully through the corner 36 and at least half way on opposite sides thereof toward the adjacent corners 38 and 40. In the particular example, the tear strip extends 4/5 of the way to the adjacent corner but it can be some what shorter. A starter tag 42 is formed on one end of the tear strip which is defined by the frangible tear line 34.

Figure 3:
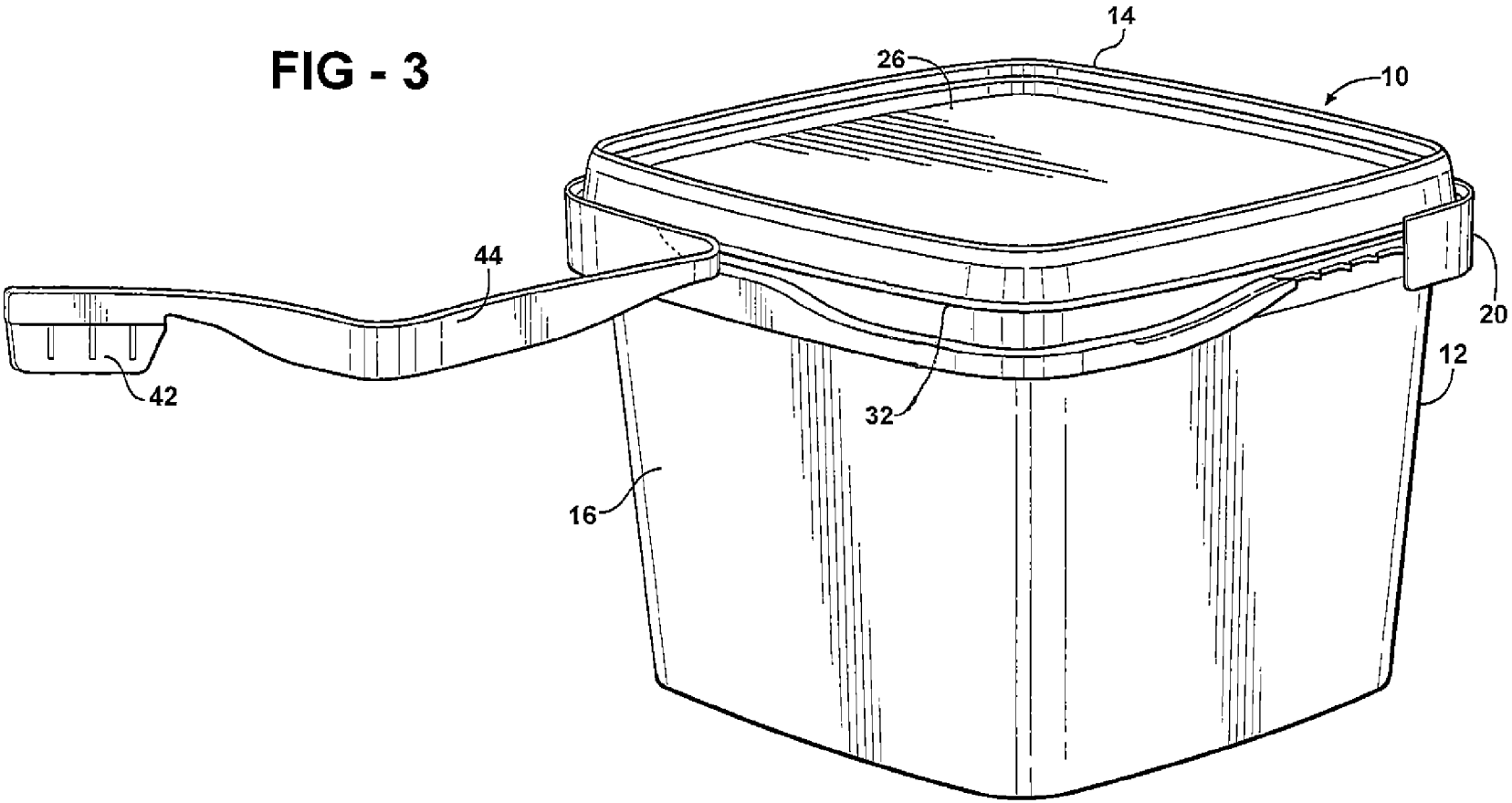
FIG. 3 is a perspective view of the container assembly of FIG. 1 with the tear strip partially removed.
Figure 4:
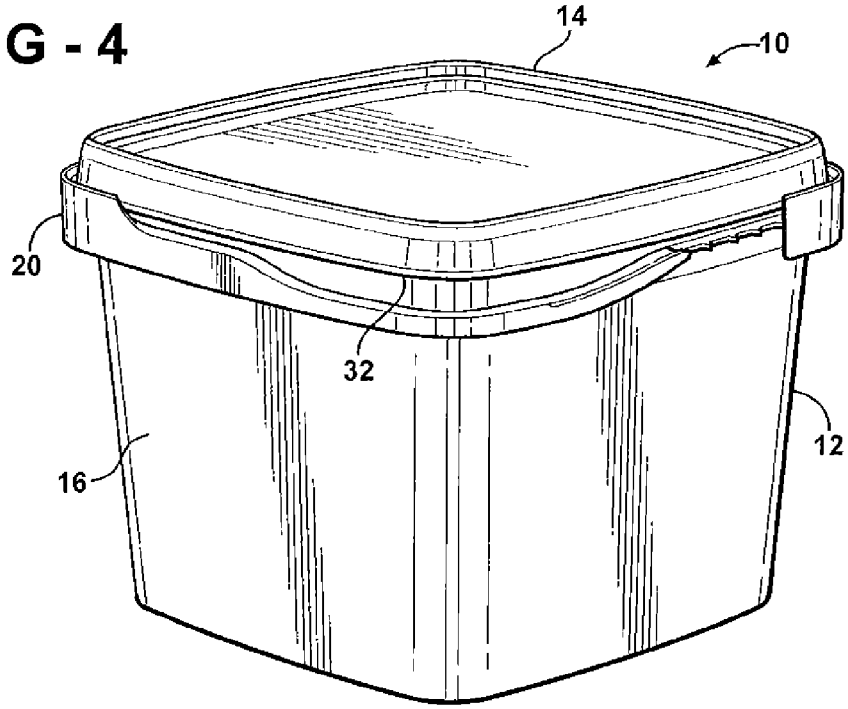
FIG. 4 is a perspective view of the container assembly of FIG. 1 with the tear strip fully removed.

In operation one grasps the starter tab 42 and separates it from the collar 20 and then pulls it outwardly and around the container assembly 10 to fully release the tear strip 44 from the collar 20 as shown in FIGS. 3 and 4. The tear strip 44 is quite large and therefore is not likely to present a choking hazard to an infant.

Figure 5:
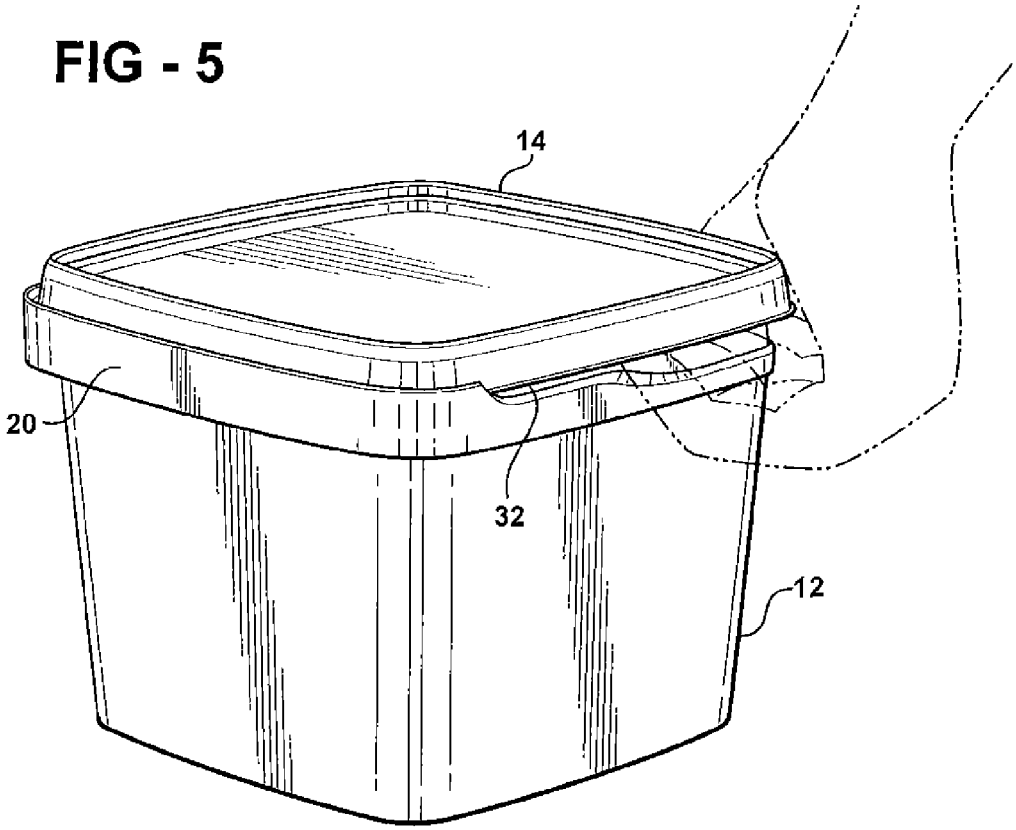
FIG. 5 is a perspective view of the container assembly of FIG. 1 showing how the removal of the tear strip provides for enhanced manual access to the lower edge of the closure.

In show in FIGS. 4 and 5, once the tear strip 44 is fully removed from the container assembly 10 it is very easy for the user to gain manual access with one's fingers to the lower edge of closure 14 thereby to remove it as shown in the beginning of the removal operation in FIG. 5.

As will be apparent to a person of ordinary skill in the art various modifications and additions to the preferred embodiment as shown herein are possible within the spirit and scope of the invention as defined in the appended claims. For example, the word "rectangular" may include square and odd shaped container.

What is claimed is:

1. A molded plastic container assembly for perishable products comprising:

a generally rectangular closed bottom, open top plastic container having four corners and a rectangular peripheral sidewall terminating in a rim defining the open top;

an integral collar surrounding the container sidewall and spaced outwardly therefrom by a rib below the rim to define an upwardly open continuous space between the collar and sidewall;

a plastic closure having an inverted u-shaped peripheral channel formed integrally therewith to sealingly fit onto and over the container rim, the closure having a continuous, uninterrupted outer skirt with a lower edge which extends into said space when the closure is seated on the container rim; said closure being pliable enough to be non-destructively manually removed from the container rim; and a tear strip formed by a frangible line in said collar extending fully through and passing through one corner in both directions therefrom and terminating between said one corner and each of the next adjacent corners; said tear strip being arranged in said collar to permit removal of an upper portion of the collar including a substantial portion of a corner thereof exposing said one corner and a substantial length of the closure lower edge within said space to facilitate removal of the closure from the container.

2. A molded plastic container assembly as defined in claim 1 further including a ribbed starter tab formed on one end of the tear strip.

3. A molded plastic container assembly as defined in claim 2 wherein the frangible line is non-linear such that the tear strip is narrower at the ends and broader at the corners.

4. A molded plastic container assembly as defined in claim 1 wherein said lower edge is outturned and contacts the inside surface of said collar when the closure is installed on said container.

* * * * *